US008684501B2

(12) United States Patent
Abbott, Jr. et al.

(10) Patent No.: US 8,684,501 B2
(45) Date of Patent: Apr. 1, 2014

(54) FLUID EJECTION DEVICE

(75) Inventors: James E. Abbott, Jr., Adair Village, OR (US); Samuel Ajayi, Corvallis, OR (US); Sadiq Bengali, Corvallis, OR (US); Stephen Horvath, San Diego, CA (US); Greg S. Long, Corvallis, OR (US); Satya Prakash, San Diego, CA (US); Alfred I-Tsung Pan, Sunnyvale, CA (US); Mohammed S. Shaarawi, Corvallis, OR (US); Roberto A. Pugliese, Tangent, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/641,469

(22) PCT Filed: Apr. 29, 2010

(86) PCT No.: PCT/US2010/032890

§ 371 (c)(1), (2), (4) Date: Oct. 16, 2012

(87) PCT Pub. No.: WO2011/136772

PCT Pub. Date: Nov. 3, 2011

(65) Prior Publication Data

US 2013/0044163 A1 Feb. 21, 2013

(51) Int. Cl.
*B41J 2/05* (2006.01)

(52) U.S. Cl.
USPC ..... 347/63

(58) Field of Classification Search
USPC ..... 347/20, 63, 68–72
See application file for complete search history.

(56) References Cited

U.S. PATENT DOCUMENTS

| | | | | |
|---|---|---|---|---|
| 6,341,848 | B1 | 1/2002 | Shade et al. | |
| 6,467,864 | B1 | 10/2002 | Cornell | |
| 6,491,380 | B2 | 12/2002 | Taneya et al. | |
| 6,637,866 | B1 | 10/2003 | Cornell et al. | |
| 7,229,158 | B2 | 6/2007 | Park et al. | |
| 7,387,370 | B2 | 6/2008 | Shaarawi et al. | |
| 2002/0024564 | A1 | 2/2002 | Teruo et al. | |
| 2002/0060721 | A1 | 5/2002 | Yoichi et al. | |
| 2007/0146438 | A1* | 6/2007 | Tanaka et al. | 347/68 |
| 2008/0259131 | A1* | 10/2008 | Cornell et al. | 347/63 |
| 2008/0303855 | A1* | 12/2008 | Bidwell et al. | 347/20 |
| 2011/0141199 | A1* | 6/2011 | Kim et al. | 347/68 |

FOREIGN PATENT DOCUMENTS

| | | |
|---|---|---|
| JP | 2006-056249 | 3/2006 |
| JP | 2008221710 | 9/2008 |
| KR | 1020050021728 | 3/2005 |
| WO | WO-2009005489 | 1/2009 |

* cited by examiner

*Primary Examiner* — Kristal Feggins
(74) *Attorney, Agent, or Firm* — Nathan R. Rieth

(57) ABSTRACT

A fluid ejection device includes a thin film heater resistor portion having a heater resistor, and a two-layer structure disposed over the heater resistor. The two-layer structure includes a top layer and a bottom layer, with the top layer having a hardness that is at least 1.5 times greater than the hardness of the bottom layer.

15 Claims, 6 Drawing Sheets

FLUID EJECTION DEVICE

BACKGROUND

In a typical inkjet printing system, an inkjet printhead ejects fluid (e.g., ink) droplets through a plurality of nozzles toward a print medium, such as a sheet of paper, to print an image onto the print medium. The nozzles are generally arranged in one or more arrays, such that properly sequenced ejection of ink from the nozzles causes characters or other images to be printed on the print medium as the printhead and the print medium are moved relative to each other.

Thermal bubble-type inkjet printheads eject droplets of fluid from a nozzle by passing electrical current through a heating element which generates heat and vaporizes a small portion of the fluid within a firing chamber. The current is supplied as a pulse which lasts on the order of 2 microseconds. When a current pulse is supplied, the heat generated by the heating element creates a rapidly expanding vapor bubble that forces a small droplet out of the firing chamber nozzle. When the heating element cools, the vapor bubble quickly collapses. The collapsing vapor bubble draws more fluid from a reservoir into the firing chamber in preparation for ejecting another drop from the nozzle.

Unfortunately, because the ejection process is repeated thousands of times per second during printing, the collapsing vapor bubbles also have the adverse effect of damaging the heating element. The repeated collapsing of the vapor bubbles leads to cavitation damage to the surface material that coats the heating element. Each of the millions of collapse events ablates the coating material. Once ink penetrates the surface material coating the heating element and contacts the hot, high voltage resistor surface, rapid corrosion and physical destruction of the resistor soon follows, rendering the heating element ineffective.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
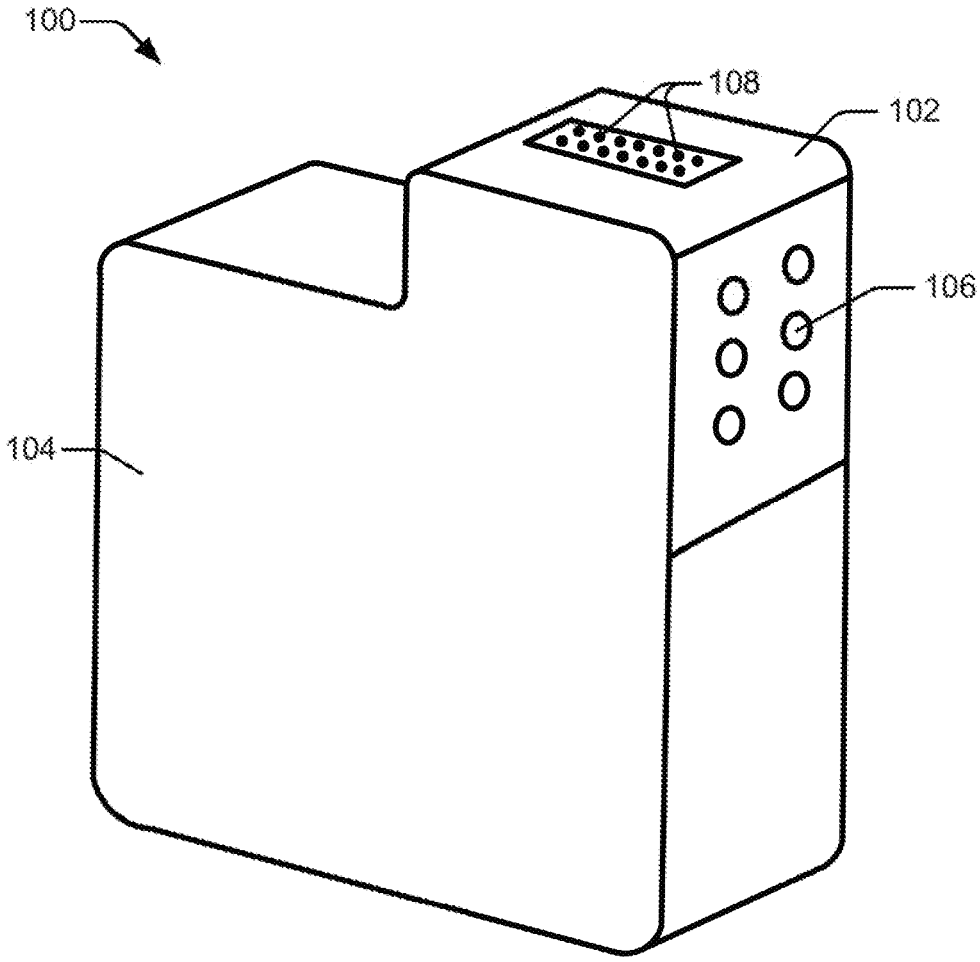
FIG. 1 illustrates an example of an inkjet print cartridge that can incorporate a fluid ejection device, according to an embodiment.

As noted above, cavitation damage to heating elements in thermal inkjet printheads accumulates over time as the drop ejection process of expanding and collapsing vapor bubbles is repeated thousands of times each second during printing.

Once cavitation has ablated the overcoat layer, the heater is destroyed and will no longer eject fluid (e.g., ink).

A common technique used to reduce the problem of cavitation damage is to make the heating element more robust so that it can better withstand the shock waves from the collapsing vapor bubbles. A hard overcoat layer formed over the heating element provides additional structural stability and electrical insulation from fluid in the firing chamber. The heating element is isolated from the fluid with a dielectric material and is then covered with another material such as tantalum. This overcoat layer is designed to protect the heating element from cavitation and other damage, and to provide structural stability resulting in an increased reliability of the heating element. Thicker overcoat layers can further increase the reliability of the heating element.

While using a hard overcoat layer provides protection to the heating element from the impact from the collapsing bubbles, this method has some shortcomings. For example, hard overcoat layers tend to absorb the impact energy rather than dissipate it. This may lead to quicker destruction of the overcoat layer and the underlying heating element. In addition, while providing a thicker overcoat layer may further delay its destruction, a thicker overcoat layer acts as a greater heat sink which dissipates the heat generated by the heating element. Thus, as the thickness of the overcoat layer increases, so too does the amount of heat that the heating element must generate to fire droplets through the nozzle. A thick overcoat layer also exhibits thermal hysteresis whereby the temperature of the overcoat layer lags behind the temperature of the heating element. The heating lag time can cause problems with ejection response time and with ink sticking to the surface of the overcoat layer as it cools. These problems can reduce the amount of heat conducting from the heating element and thereby degrade the ability of the printhead to properly eject ink.

Embodiments of the present disclosure improve on the shortcomings mentioned above through the use of a cavitation barrier that has a hard top layer to resist deformation under the impact of cavitation and an adjacent, softer bottom layer to dissipate energy from shock waves of the collapsing vapor bubbles. The combination layer, having a hard material on a softer material, better inhibits the cavitation damage than a monolithic layer of either material alone.

In one embodiment, for example, a fluid ejection device includes a thin film heater resistor portion having a heater resistor, and a two-layer structure disposed over the heater resistor. The two-layer structure includes a top layer and a bottom layer, with the top layer having a hardness that is at least 1.5 times greater than the hardness of the bottom layer.

In another embodiment, a fluid ejection device includes a thin film heater resistor portion having a plurality of heater resistors, a fluid barrier layer disposed over the thin film resistor portion, respective fluid chambers formed in the barrier layer over respective heater resistors, and an orifice plate having nozzles formed over respective fluid chambers and heater resistors. The device further includes a cavitation barrier structure having top and bottom layers disposed between the fluid chambers where the top layer has a hardness that is at least 1.5 times greater than the hardness of the bottom layer.

In another embodiment, a method of making a fluid ejection device includes forming a thin film heater resistor layer having a plurality of heater resistors, forming a dielectric passivation layer on the resistor layer, and forming the bottom layer of a cavitation barrier on the dielectric passivation layer. The method further includes forming the top layer of the cavitation barrier on the bottom layer such that the top layer has a hardness that is at least 1.5 times greater than the hardness of the bottom layer.

ILLUSTRATIVE EMBODIMENTS

FIG. 1 illustrates an example of an inkjet print cartridge 100 that can incorporate a fluid ejection device as disclosed herein, according to an embodiment. In this embodiment, the fluid ejection device is disclosed as a fluid drop jetting printhead 102. The print cartridge 100 includes a cartridge body 104, printhead 102, and electrical contacts 108. The cartridge body 104 contains ink or other suitable fluid that is supplied to the printhead 102. Individual fluid drop generators in printhead 102 are energized by electrical signals provided at contacts 106 to eject droplets of fluid from selected nozzles 108. Print cartridge 100 may contain its own fluid supply such as ink within cartridge body 104, or it may receive ink from an external supply (not shown) such as a fluid reservoir connected to the print cartridge 100 through a tube, for example. Print cartridges 100 containing their own fluid supplies are generally disposable once the fluid supply is depleted.

Figure 2:
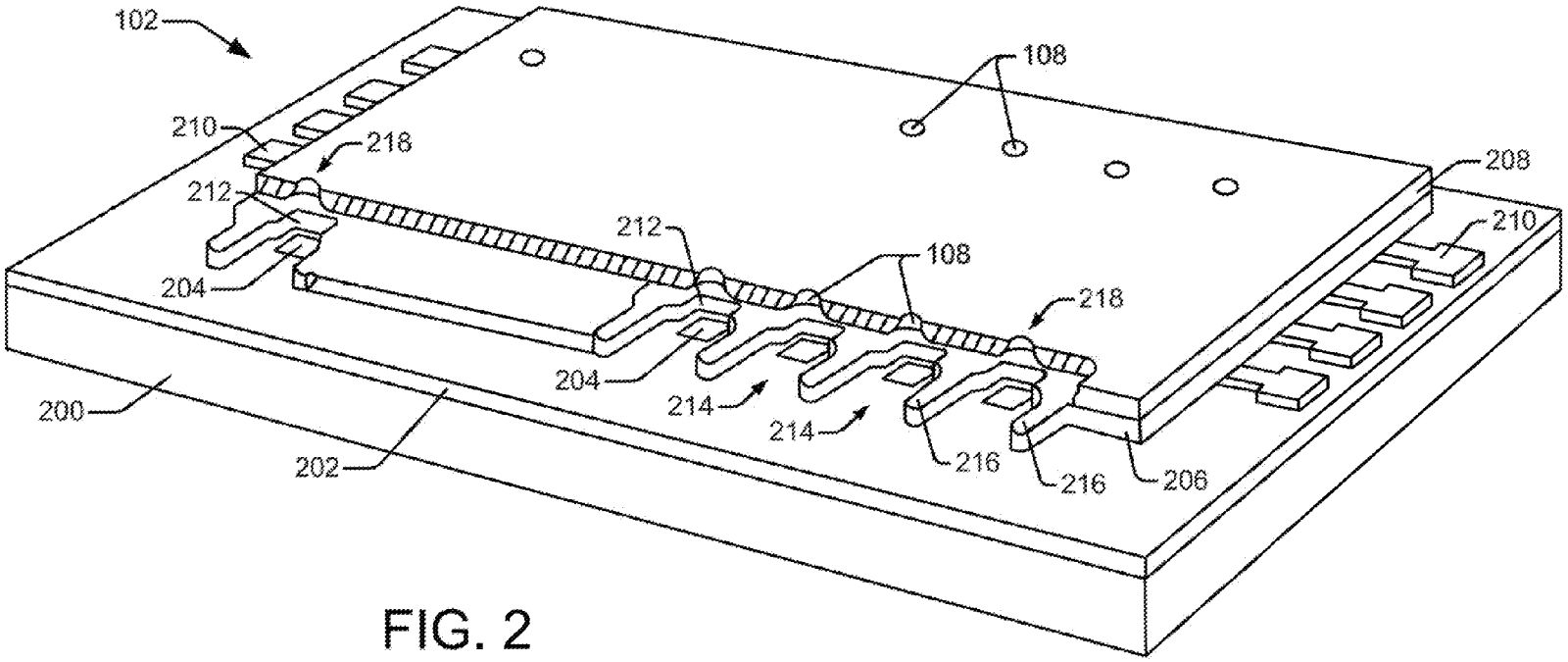
FIG. 2 illustrates a perspective view of an example thermal inkjet printhead, according to an embodiment.

FIG. 2 illustrates a perspective view of an example fluid drop jetting printhead 102 embodied as a thermal inkjet printhead 102. As shown, printhead 102 includes a silicon substrate 200 and an integrated circuit thin film stack 202 of thin film layers formed on the silicon substrate 200. The thin film stack 202 implements thin film fluid drop firing heater resistors 204 and associated electrical circuitry such as drive circuits and addressing circuits, and can be formed pursuant to integrated circuit fabrication techniques. In the example embodiment, heater resistors 204 are located in columnar arrays along longitudinal ink feed edges (not shown) formed within the silicon substrate 200.

A fluid barrier layer 206 is disposed over the thin film stack 202, and an orifice or nozzle plate 208 containing the nozzles 108 is in turn luminary disposed on the fluid barrier layer 206. In other embodiments, the fluid barrier layer 206 and orifice plate 208 can be implemented as an integral fluid channel and orifice structure. Bond pads 210 can be disposed at the ends of the thin film stack 202 and are not covered by the fluid barrier layer 206 in order to provide for external electrical connections. The fluid barrier layer 206 is formed, for example, of a dry film that is heated and pressure laminated to the thin film stack 202 and photodefined to form fluid chambers 212 and fluid channels 214. The barrier layer 206 material comprises, for example, an acrylate based photopolymer dry film. Nozzles 108 are formed in the orifice plate 208, for example, by laser ablation. The orifice plate 208 comprises a planar substrate comprised of a polymer material or a plated metal such as nickel, for example.

The fluid chambers 212 in the fluid barrier layer 206 are more particularly disposed over respective heater resistors 204 formed in the thin film stack 202, and each fluid chamber 212 is defined by the edge or wall of a chamber opening formed in the fluid barrier layer 206. The fluid channels 214 are defined by barrier features formed in the barrier layer 206 including barrier peninsulas 216, and are integrally joined to respective fluid chambers 212.

Nozzles 108 in the orifice plate 208 are disposed over respective fluid chambers 212, such that a heater resistor 204, an associated fluid chamber 212, and an associated nozzle 108 form a drop generator 218. In operation, a selected heater resistor is energized with electric current. The heater resistor produces heat that heats fluid in the adjacent fluid chamber. When the fluid in the chamber reaches vaporization, a rapidly expanding vapor front or drive bubble forces liquid within the fluid chamber through an adjacent nozzle. A heater resistor and an associated fluid chamber thus form a bubble generator.

Figure 3:
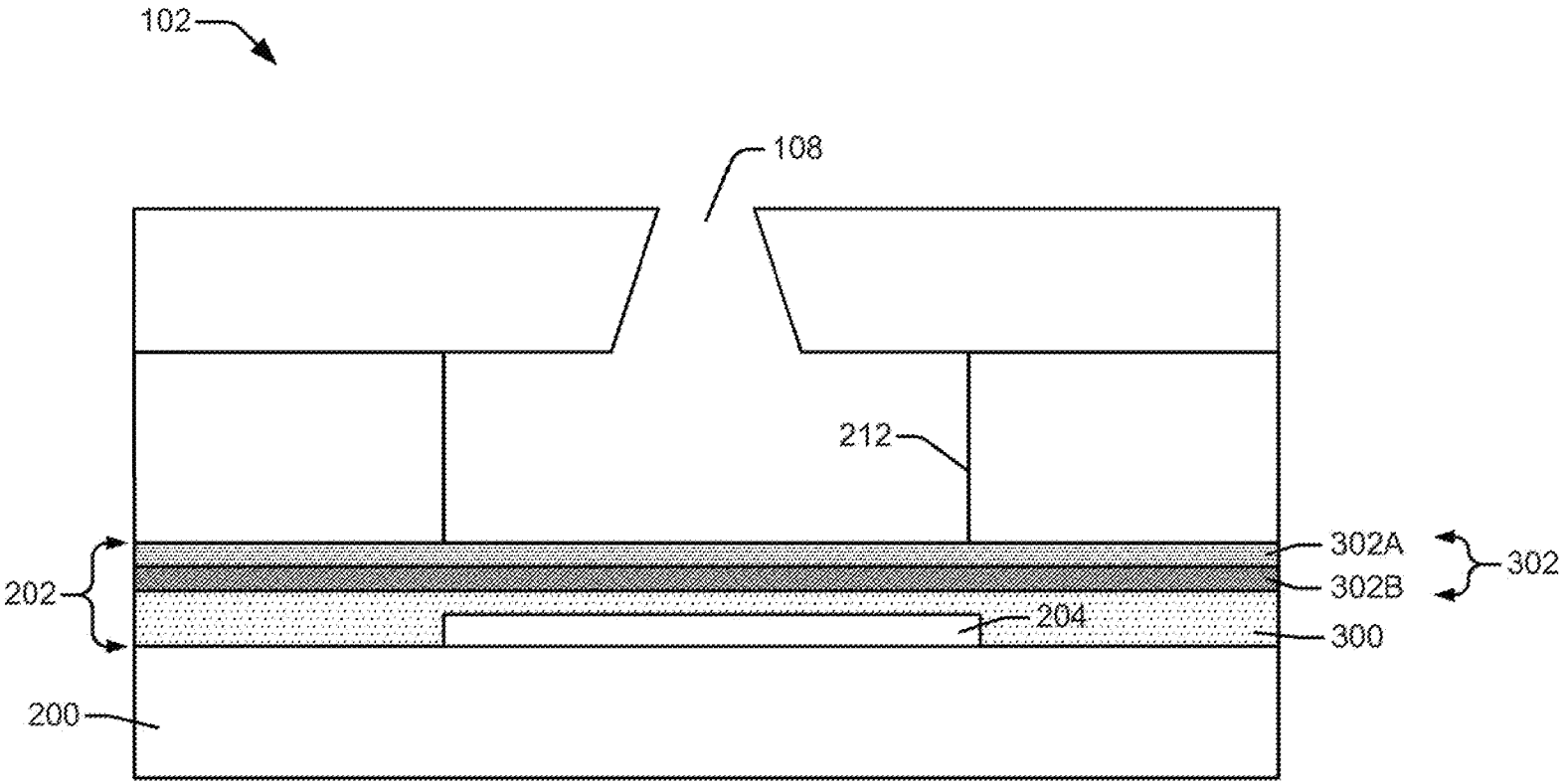
FIG. 3 illustrates a partial side view of an example thermal inkjet printhead, according to an embodiment.

FIG. 3 illustrates a partial side view of an example thermal inkjet printhead 102, according to an embodiment. An embodiment of the thin film stack 202 includes a heater resistor portion 300 in which the thermal/heater resistors 204 are formed. Resistors 204 are typically formed, for example, of tantalum-aluminum (TaAl) or tungsten silicon-nitride (WSiN). A two-layer passivation structure 302 disposed on the heater resistor portion 300 functions as a mechanical passivation or protective cavitation barrier structure in the fluid chamber 212 to absorb the shock of the collapsing drive bubble and to dissipate the energy of the shock wave.

The two-layer structure 302 includes a bottom layer 302B disposed on the heater resistor portion 300, and a top layer 302A disposed on the bottom layer 302B. In one embodiment, the top layer 302A is selected to be a thin layer of material with a hardness that is at least 1.5 times greater than the hardness of the underlying bottom layer 302B. In such embodiments the hard top layer 302A resists deformation under the impact of cavitation while the softer bottom layer 302B dissipates energy from the shock wave of the collapsing drive bubble. The combination of the hard and soft layers inhibits damage more effectively than a monolithic layer of either the hard or soft material.

In one embodiment, the top layer 302A has a hardness of greater than about 12 gigapascals (GPa) and the bottom layer has a hardness of less than about 6.8 GPa. In such an embodiment the top layer 302A material can be, for example, a platinum-ruthenium (PtRu) alloy while the bottom layer 302B material can be platinum (Pt). In addition, the top layer 302A has a thickness in the range of about 200 angstroms to about 1000 angstroms, while the bottom layer 302B has a thickness in the range of about 1000 angstroms to about 2 microns.

Figure 4:
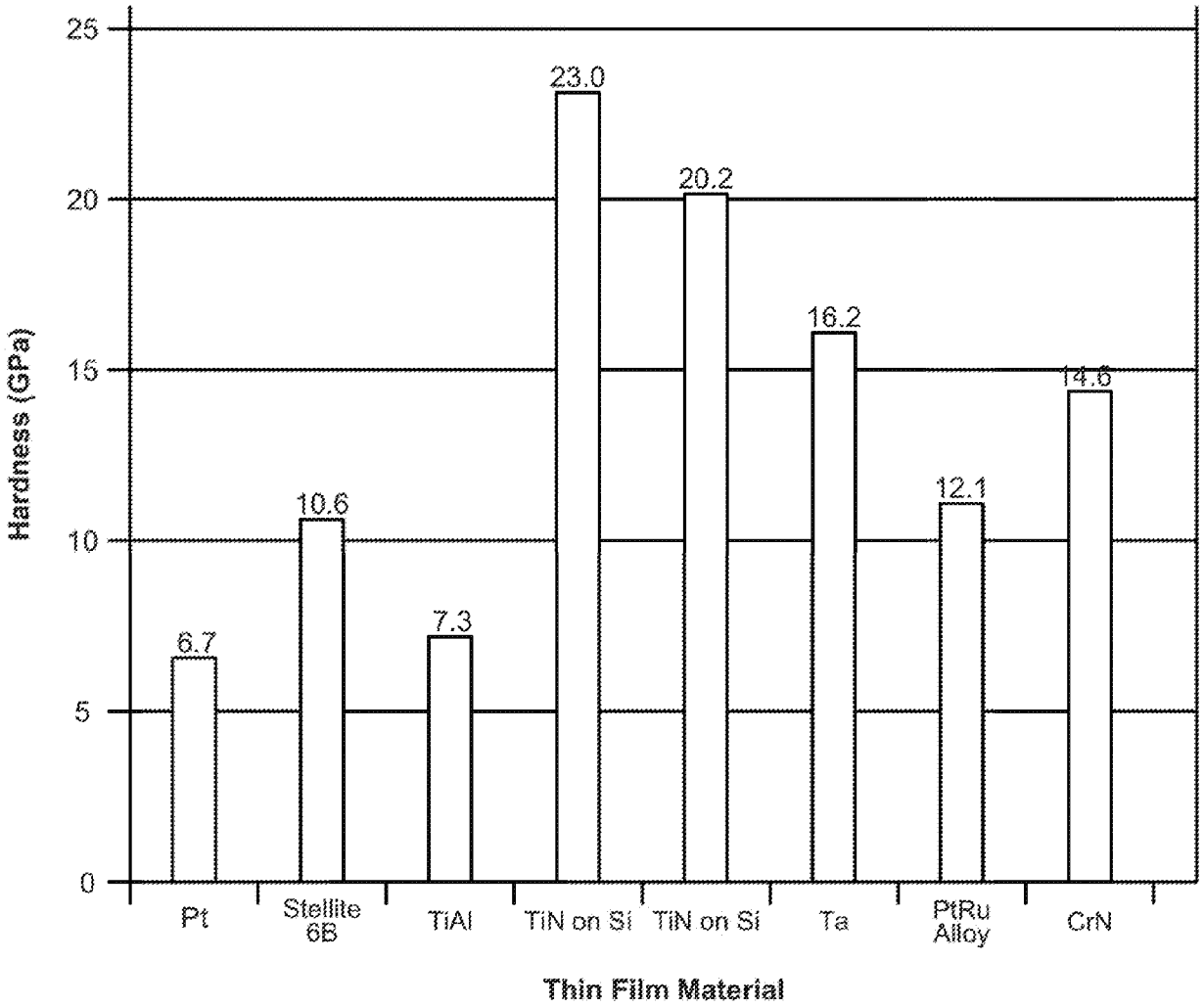
FIG. 4 shows a graph that provides hardness data measured for various example thin film materials that may be suitable for use in a two-layer passivation structure, according to different embodiments.

FIG. 4 shows a graph that provides hardness data measured for various example thin film materials that may be suitable for use in the two-layer passivation structure 302, according to different embodiments. The graph enables a comparison of the differential hardness for each of the materials shown. Accordingly, the data can be used to select suitable materials to use for the top layer 302A and the bottom layer 302B based on differentials in hardness where the top layer 302A material is at least 1.5 times greater in hardness than the bottom layer 302B material. For example, based on the hardness data provided for PtRu alloy (12.1 GPa) and Pt (6.7 GPa), a suitable choice for the top layer 302A is a PtRu alloy, when coupled with a softer bottom layer 302B of Pt. Other examples of suitable choices from the graph in FIG. 4 include chromium-nitride (CrN) or tantalum (Ta) for the top layer 302A, when coupled with a softer bottom layer 302B of titanium-aluminum (TiAl (RT)).

Likewise, there are various other materials that are suitable for use as top and bottom layer materials in the two-layer passivation structure 302, so long as they fall within a relative hardness range where the top layer 302A has a hardness that is at least 1.5 times greater than the hardness of the bottom layer 302B. For example, some material options available for use as the bottom layer 302A include gold (Au) and platinum (Pt) as previously mentioned, which are both good choices due to their malleability. Some example materials that can be acceptable options for the top layer 302A are based on relatively hard metals, such as platinum-ruthenium (PtRu) alloys, platinum-rhodium (PtRh) alloys, platinum-iridium (PrIr) alloys, iridium (Ir), tantalum (Ta), tantalum zirconium (TaZr) alloys, chromium, tantalum chromium (TaCr) alloys, nickel-chromium (NiCr) alloys, stellite 6B, cobalt-chromium (CoCr) alloys, and low stress stainless steel alloys. Other example materials that can be acceptable options for the top layer 302A are based on intermetallic compounds such as titanium-aluminum (TiAl) alloys, titanium-nitride (TiN), and tantalum-nitride (TaN). Still other example materials that can be acceptable options for the top layer 302A are based on hard dielectric materials such as hafnium-oxide (HfO), silicon-carbide (SiC), tantalum-carbide (TaC), zirconium-oxide (ZrO) and diamond-like carbon.

Figure 5:
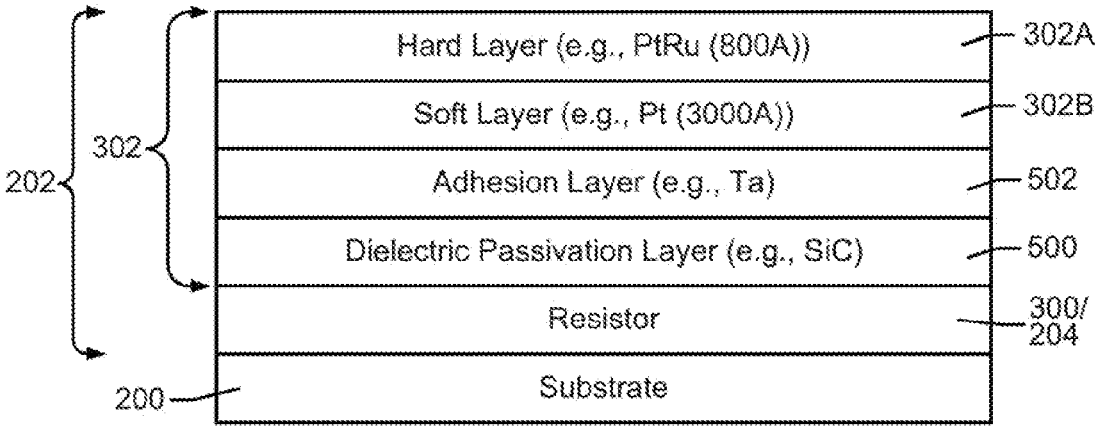
FIG. 5 illustrates a thin film stack on a substrate where a two-layer passivation structure includes an intervening dielectric passivation layer and an intervening adhesion layer, according to an embodiment.

Although FIG. 3 shows the two-layer passivation structure 302 as including just a top layer 302A and a bottom layer 302B, it can also include additional intervening layers. For example, FIG. 5 illustrates the thin film stack 202 on top of substrate 200 where the two-layer passivation structure 302 includes an intervening dielectric passivation layer 500 disposed on the resistor/resistor layer 300/204, and an intervening adhesion layer 502 disposed between the dielectric passivation layer 500 and bottom layer 302B. There may in some embodiments be an additional adhesion layer (not shown) disposed between bottom and top layers. The dielectric layer is an electrically resistant thin film layer that electrically passivates the thermal resistor/resistor layer 300/204 and can be formed, for example, of silicon-carbide (SiC). The adhesion layer shown in FIG. 5 promotes adhesion between the dielectric passivation layer 500 and bottom layer 302B and may be used because some materials do not adhere well to other materials. For example, a Pt bottom layer 302B may not adhere well to a SiC dielectric passivation layer 500. As noted, an additional adhesion layer (not shown) can be added over the bottom layer 302B to promote adhesion between the bottom layer 302B and top layer 302A depending on the particular materials selected for the bottom and top layers. Some examples of materials suitable for use as an adhesion layer include tantalum (Ta), titanium (Ti), titanium-nitride (TiN), tantalum-nitride (TaN) and chromium (Cr).

Figure 6:
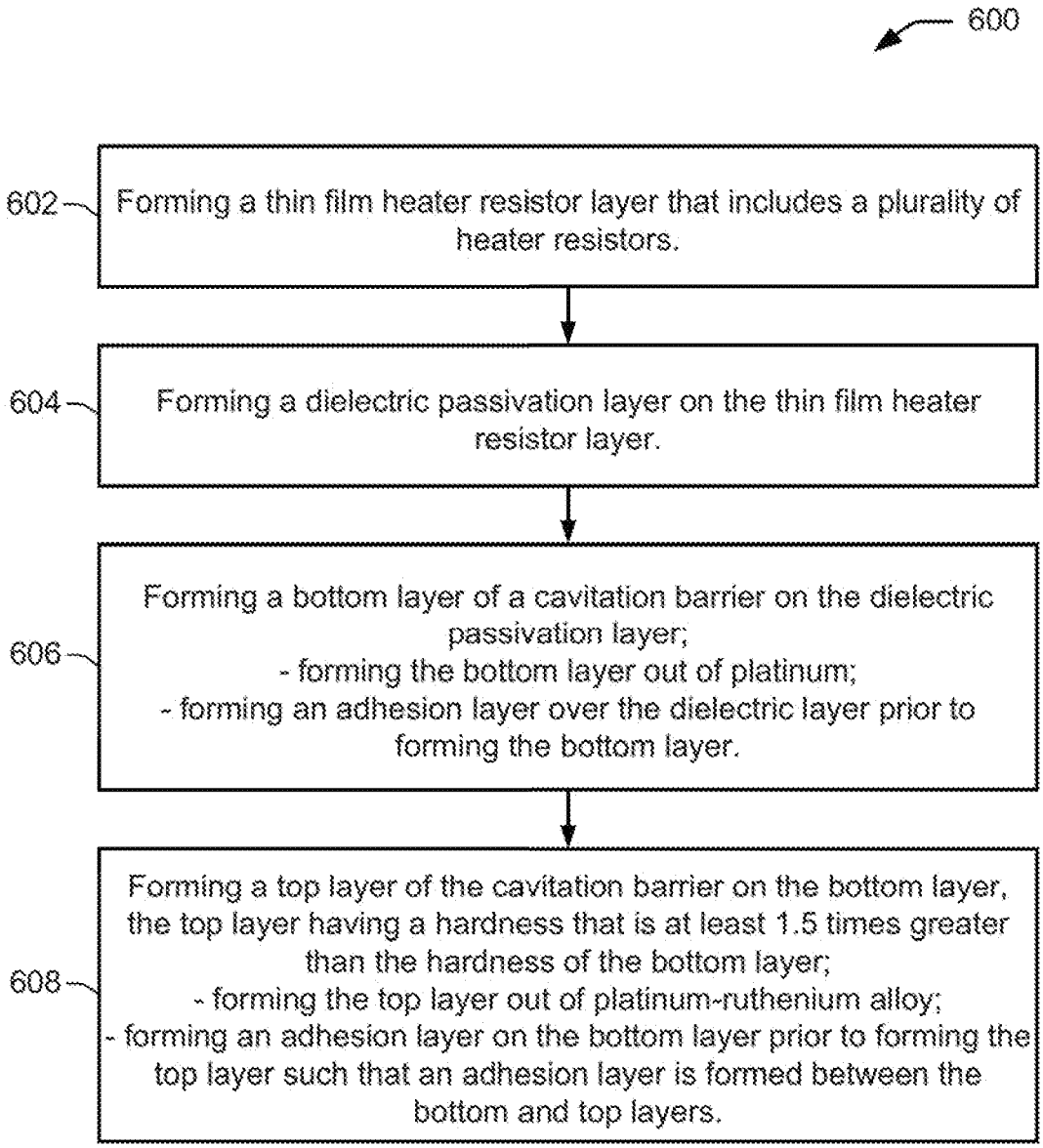
FIG. 6 shows a flowchart of an example method of fabricating a fluid ejection device such as a thermal inkjet printhead, according to an embodiment.

FIG. 6 shows a flowchart of an example method 600 of fabricating a fluid ejection device such as a thermal inkjet printhead, according to an embodiment. Method 600 is associated with the embodiments of a thermal inkjet printhead 200 discussed above with respect to illustrations in FIGS. 2-5. Although method 600 includes steps listed in a certain order, it is to be understood that this does not limit the steps to being performed in this or any other particular order. In general, the steps of method 600 may be performed using various precision microfabrication techniques such as electroforming, laser ablation, anisotropic etching, sputtering, dry etching, photolithography, casting, molding, stamping, and machining as are well-known to those skilled in the art.

Method 600 begins at block 602 with forming a thin film heater resistor layer that includes a plurality of heater resistors. The thin film heater resistor layer is generally part of an integrated circuit thin film stack of thin film layers formed on silicon substrate. At block 604, a dielectric passivation layer is formed on the thin film heater resistor layer. As noted above, the dielectric passivation layer is an electrically resistant thin film layer that electrically passivates the heater resistor layer. At block 606 of method 600, a bottom layer of a cavitation barrier is formed on the dielectric passivation layer. In one embodiment, the bottom layer is formed out of platinum. In an intervening step, method 600 may also include forming an adhesion layer over the dielectric layer prior to forming the bottom layer. At block 608 of method 600, a top layer of the cavitation barrier is formed on the bottom layer, where the top layer has a hardness that is at least 1.5 greater than the hardness of the bottom layer. In one embodiment, the top layer is formed out of platinum-ruthenium alloy. In an intervening step, method 600 may also include forming an adhesion layer between the bottom and top layers.

What is claimed is:

1. A fluid ejection device comprising:

a thin film heater resistor portion that includes a heater resistor; and a two-layer structure disposed over the heater resistor that includes a top layer and a bottom layer, the top layer having a hardness that is at least 1.5 times greater than the hardness of the bottom layer.

2. A fluid ejection device as recited in claim 1 wherein the top layer has a hardness of greater than about 12 gigapascals and the bottom layer has a hardness of less than about 6.8 gigapascals.

3. A fluid ejection device as recited in claim 1 wherein the top layer comprises a platinum-ruthenium alloy.

4. A fluid ejection device as recited in claim 3 wherein the bottom layer comprises platinum.

5. A fluid ejection device as recited in claim 1, wherein:

the top layer comprises a material selected from the group consisting of a titanium aluminum alloy, titanium nitride, tantalum nitride, hafnium oxide, silicon carbide, tantalum carbide, zirconium oxide and diamond like carbon; and the bottom layer comprises platinum.

6. A fluid ejection device as recited in claim 1, wherein the top layer has a thickness in the range of about 200 Angstroms to about 1000 Angstroms, and the bottom layer has a thickness in the range of about 1000 Angstroms to about 2 microns.

7. A fluid ejection device as recited in claim 1, further comprising a dielectric passivation layer disposed over the heater resistor between the bottom layer and the heater resistor.

8. A fluid ejection device as recited in claim 7, further comprising an adhesion layer between the dielectric passivation layer and the bottom layer to adhere the bottom layer to the dielectric passivation layer.

9. A fluid ejection device as recited in claim 8, wherein the adhesion layer comprises a material selected from the group consisting of tantalum, titanium, titanium-nitride, tantalum-nitride and chromium.

10. A fluid ejection device as recited in claim 1, further comprising an adhesion layer between the top layer and the bottom layer to adhere the top layer to the bottom layer.

11. A fluid ejection device as recited in claim 1, wherein the top layer comprises a material selected from the group consisting of platinum-ruthenium alloys, platinum-rhodium alloys, platinum-iridium alloys, iridium, tantalum, tantalum zirconium alloys, tantalum chromium alloys, nickel-chromium alloys, stellite 6B, cobalt-chromium alloys, stainless steel alloys, titanium-aluminum alloys, titanium-nitride, tantalum-nitride, hafnium-oxide, silicon-carbide, tantalum-carbide, zirconium-oxide and diamond-like carbon.

12. A fluid ejection device as recited in claim 1 wherein the bottom layer comprises gold.

13. A fluid ejection device comprising:

a thin film heater resistor portion that includes a plurality of heater resistors;

a fluid barrier layer disposed over the thin film resistor portion;

respective fluid chambers formed in the barrier layer over respective heater resistors;

an orifice plate having nozzles formed therein, each nozzle disposed over a respective fluid chamber and heater resistor; and a cavitation barrier structure including top and bottom layers disposed between the fluid chambers wherein the top layer has a hardness that is at least 1.5 times greater than the hardness of the bottom layer.

14. A method of making a fluid ejection device comprising:

forming a thin film heater resistor layer that includes a plurality of heater resistors;

forming a dielectric passivation layer on the resistor layer;

forming on the dielectric passivation layer, a bottom layer of a cavitation barrier;

forming on the bottom layer, a top layer of the cavitation barrier having a hardness that is at least 1.5 times greater than the hardness of the bottom layer.

15. A method as recited in claim 14, wherein:

forming the bottom layer comprises forming a layer comprising platinum; and forming the top layer comprises forming a layer comprising a platinum-ruthenium alloy.

* * * * *